US011745929B2

(12) United States Patent
Nelson

(10) Patent No.: US 11,745,929 B2
(45) **Date of Patent: *Sep. 5, 2023**

(54) SYSTEM AND METHOD OF STORING PRODUCE

(71) Applicant: Mission Produce, Inc., Oxnard, CA (US)

(72) Inventor: Charles Nelson, Oxnard, CA (US)

(73) Assignee: Mission Produce, Inc., Oxnard, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/403,625

(22) Filed: Aug. 16, 2021

(65) Prior Publication Data

US 2021/0371183 A1 Dec. 2, 2021

Related U.S. Application Data

(63) Continuation of application No. 16/425,784, filed on May 29, 2019, now Pat. No. 11,117,727.

(51) Int. Cl.

| | |
|---|---|
| ***B65D 77/20*** | (2006.01) |
| ***B65D 1/36*** | (2006.01) |
| ***B65D 21/02*** | (2006.01) |
| ***B65D 77/30*** | (2006.01) |

(52) U.S. Cl.

CPC ..... *B65D 77/2024* (2013.01); *B65D 1/36* (2013.01); *B65D 21/023* (2013.01); *B65D 21/0233* (2013.01); *B65D 77/30* (2013.01)

(58) Field of Classification Search

CPC .... B65D 77/2024; B65D 1/36; B65D 21/023; B65D 21/0233; B65D 77/30; B65D 81/26; B65D 2251/0018; B65D 2251/009; B65D 51/1644; B65D 2565/388; B65D 33/01; B65D 85/34

USPC ..... 220/367.1

See application file for complete search history.

(56) References Cited

U.S. PATENT DOCUMENTS

| | | | | |
|---|---|---|---|---|
| 3,716,180 | A | 2/1973 | Bemiss | |
| 4,886,372 | A | 12/1989 | Greengrass et al. | |
| 6,667,067 | B1 | 12/2003 | Noel et al. | |
| 7,329,452 | B2 | 2/2008 | Clarke et al. | |
| 7,601,374 | B2 | 10/2009 | Clarke | |
| 7,621,412 | B2 | 11/2009 | Raniwala | |
| 2005/0266129 | A1 | 12/2005 | Mir | |
| 2008/0166458 | A1 | 7/2008 | Weber | |
| 2012/0187122 | A1* | 7/2012 | Glasow | B65B 7/16 220/359.4 |
| 2017/0107048 | A1 | 4/2017 | Adam | |
| 2017/0305633 | A1 | 10/2017 | Pickard | |
| 2018/0141738 | A1 | 5/2018 | Armano | |

* cited by examiner

*Primary Examiner* — Shawn M Braden

(74) *Attorney, Agent, or Firm* — SoCal IP Law Group LLP; Guy Cumberbatch; Steven C. Sereboff

(57) ABSTRACT

A system and method for storing, shipping, preserving and ripening produce. Packaging of respiring produce, particularly avocados, in sealed tray systems. The tray systems include a lower bowl-shaped tray having an upper lip to which a flexible film is adhered. The flexible film has an aperture covered by a breathable membrane. The film permits passage of water vapor to reduce the chance of mold formation during packaging and shipping. The breathable membrane controls gaseous exchange at different temperatures and has pores that open above the threshold temperature. The breathable membrane alters the $O_2$ and $CO_2$ within the tray above the threshold temperature, thus slowing up the ripening process at elevated temperatures.

20 Claims, 7 Drawing Sheets

SYSTEM AND METHOD OF STORING PRODUCE

RELATED APPLICATIONS

This patent is a continuation of application Ser. No. 16/425,784 filed May 29, 2019, the disclosure of which is expressly incorporated herein by reference.

NOTICE OF COPYRIGHTS AND TRADE DRESS

A portion of the disclosure of this patent document contains material which is subject to copyright protection. This patent document may show and/or describe matter which is or may become trade dress of the owner. The copyright and trade dress owner has no objection to the facsimile reproduction by anyone of the patent disclosure as it appears in the Patent and Trademark Office patent files or records, but otherwise reserves all copyright and trade dress rights whatsoever.

BACKGROUND

Field

This disclosure relates to a system and a method for storing, shipping, preserving and ripening produce. More particularly, the present invention is concerned with a packaging system for encasing and controlling ripening of produce and fruits, etc.

Description of the Related Art

Respiring biological materials, e.g. fruits and vegetables, consume oxygen $O_2$ and produce carbon dioxide $CO_2$ at rates which depend upon the stage of their development, the atmosphere surrounding them and the temperature. In certain produce packaging, the objective is to produce a desired atmosphere around respiring materials by placing them in a sealed container whose permeability to $O_2$ and $CO_2$ is correlated with (i) the partial pressures of $O_2$ and $CO_2$ in the air outside the package, and (ii) the temperature, to produce a desired atmosphere within the container. The following US patents and patent publications pertain to packaging systems in this area: U.S. Pat. Nos. 4,886,372, 7,601,374, 7,329,452 and US20050266129.

Despite numerous attempts to control the ripening of produce prior to being displayed on the shelves in the market, there remains a need for a more sensitive and accurate packaging system, especially for controlling the ripening of produce such as avocados.

SUMMARY OF THE INVENTION

According to exemplary embodiments, a produce tray system is provided. The produce tray system includes a molded produce tray of solid continuous construction without vents having a general bowl-shape with a floor and upstanding walls rising to an upper lip. The floor and upstanding walls surround an inner cavity and have contours which form multiple compartments for cradling separate pieces of produce within the inner cavity. A flexible film attached across the upper lip, the film being configured to permit passage of water vapor and having an aperture formed therein. Finally, a breathable membrane is adhered across the aperture, the membrane having a structure which lower the rate of $CO_2$ transmission relative to $O_2$ transmission for higher temperatures.

An alternative produce tray system has a molded produce tray of solid continuous construction without vents defining a general bowl-shape with a floor and upstanding walls rising to an upper lip, the floor and upstanding walls surrounding an inner cavity. A flexible film attaches across the upper lip, the film being configured to permit passage of water vapor and having an aperture formed therein. A breathable membrane formed in the shape of a patch and sized to occlude the aperture is adhered across the aperture on an underside of the film within the inner cavity. The membrane has a breathable structural base layer and a polymer layer adhered thereto having pores and configured to lower the rate of $CO_2$ transmission relative to $O_2$ transmission for higher temperatures.

Other features and characteristics of the present invention, as well as the methods of operation, functions of related elements of structure and the combination of parts, and economies of manufacture, will become more apparent upon consideration of the following description and the appended claims with reference to the accompanying drawings, all of which form a part of this specification, wherein like reference numerals designate corresponding parts in the various figures.

DETAILED DESCRIPTION

The present application provides an improved produce tray system for storing produce during shipping and for display purposes. The produce tray system includes a lower relatively rigid produce tray covered with a flexible film and breathable membrane. The term "relatively rigid" refers to the solid nature of the produce tray relative to the flexible film. That is, the produce tray is preferably a molded polymer with sufficient rigidity to maintain its shape so that it may be stacked or nested with identical produce trays prior to assembly, and holds its shape when filled with produce. It should be understood that while the produce tray is formed so as to produce desirable airflow between stacked assembled tray systems, there are a number of particular shapes to produce such airflow, and the illustrated embodiment is merely exemplary.

Figure 1:
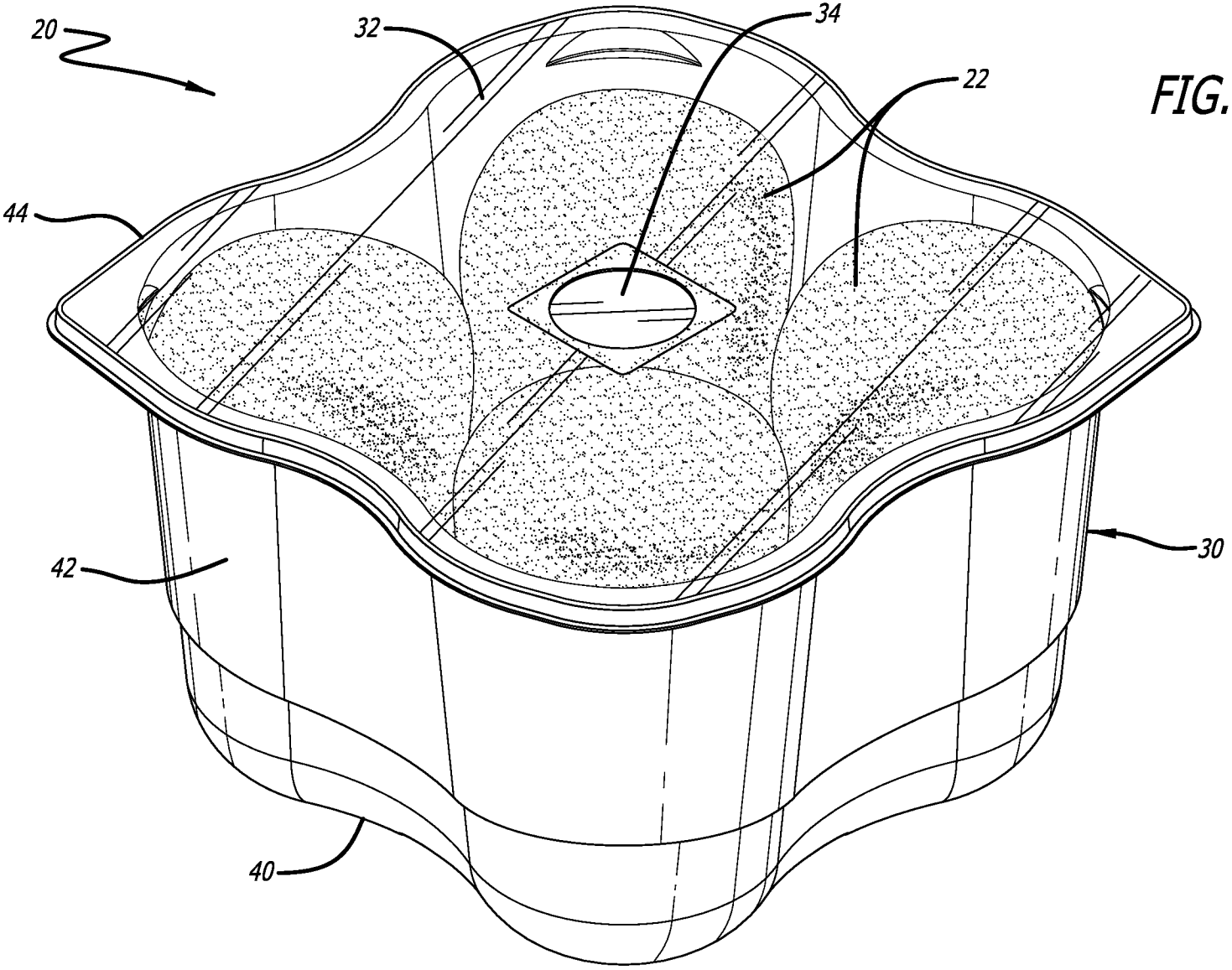
FIG. 1 is a perspective view of an assembled produce tray system in accordance with the present application containing a number of avocados.
Figure 2:
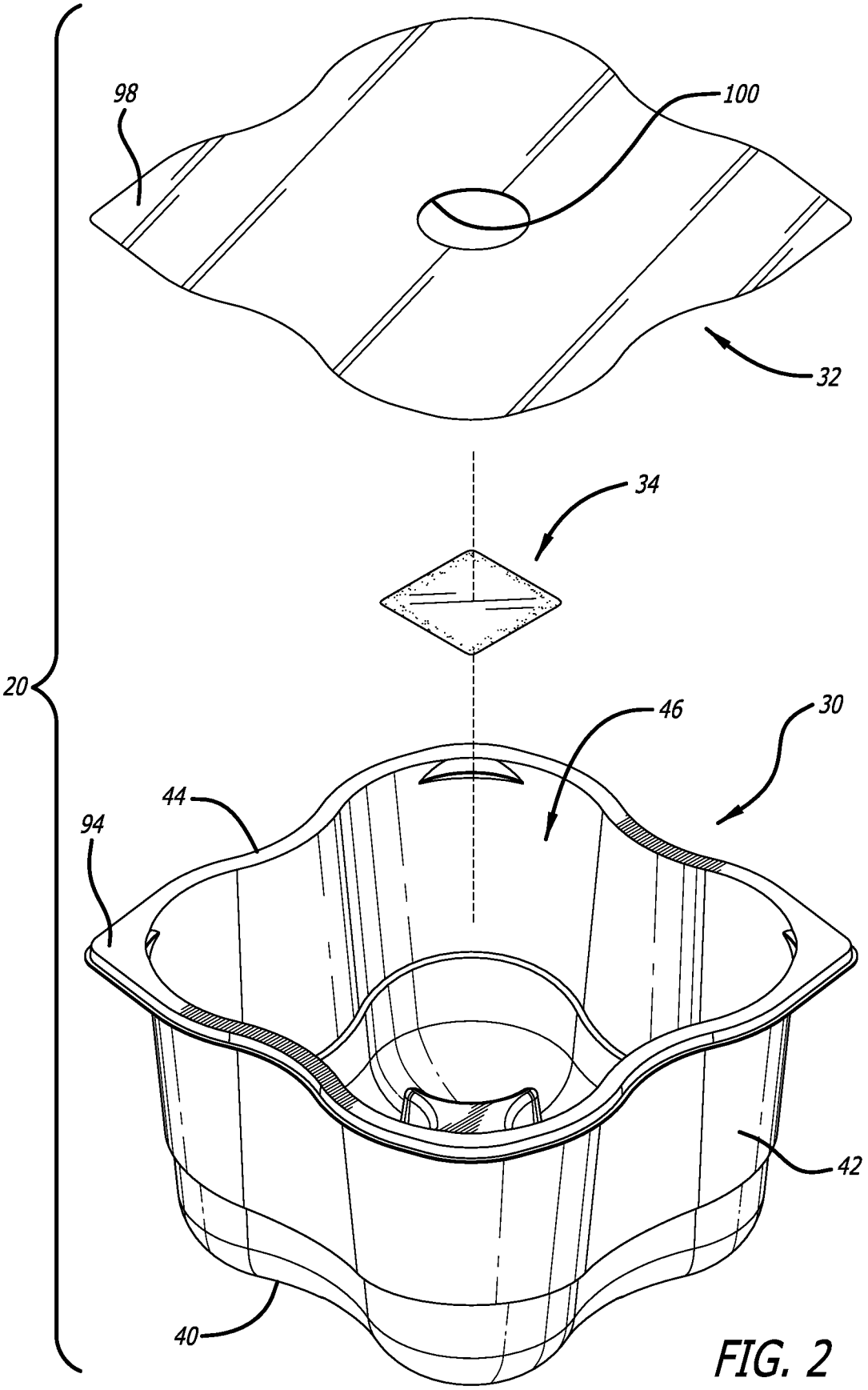
FIG. 2 is an exploded perspective view of the produce tray system of the present application including a relatively rigid produce tray covered by a flexible film and a breathable membrane.

FIG. 1 is a perspective view of an assembled produce tray system 20 in accordance with the present application containing a number of avocados 22, and FIG. 2 is an exploded perspective view of the produce tray system. The system 20 comprises a relatively rigid lower produce tray 30 covered by a flexible film 32 and a breathable membrane 34.

The produce tray 30 has a general bowl shape with a floor 40 and a plurality of upstanding walls 42. An upper lip 44 defines a top edge of the produce tray 30 surrounding a relatively large upper opening leading to an inner cavity 46. The illustrated produce tray 30 is sized and shaped to contain a plurality, specifically four, avocados, and thus is shaped accordingly. However, it should be understood those of skill in the art that the size and shape of the produce tray could be modified for other fruits and vegetables.

In the exemplary embodiment, the produce tray 30 defines four regions within the inner cavity 46 within which four avocados can be separated. More particularly, and as seen best in the perspective of FIG. 5, the floor 40 has a lower, generally horizontal surface 48 that sits on a table or may be stacked on top of another tray system 20. The lower surface 48 is segregated into four sectors by a cross-shaped channel system including a central depression 50 in communication with four outwardly extending radial channels 52. The channels 52 more generally form a spoke-shaped array of radial channels which may consist of more or less than four channels. It should be understood that the produce tray 30 is molded so as to have solid, continuous walls without holes or vents, and as such the concave lower channel system from the bottom is mirrored by inversely-shaped convex protrusions within the inner cavity 46, as seen in FIG. 6. Consequently, looking from above, the floor 40 features an upstanding central protrusion 60 having four lobes 62 connected to four shorter rails 64 that mirror the radial channels 52.

The central protrusion 60 extends upward from the lower surface 48 of the floor 40 to a height of between about ¼ to ½ of a total height of the tray 30, while the rails 64 do not extend upward as far as the central protrusion 60, and preferably only between 5-10% of the total height. This can also be seen in the sectional views of FIGS. 7 and 8. The molded contours of the floor 40 are smooth and rounded in all respects to avoid sharp corners within the interior cavity 46 which might damage the produce held therein. Preferably, the tray 30 is molded of a suitable polymer such as polyethylene terephthalate (PET).

Figure 5:
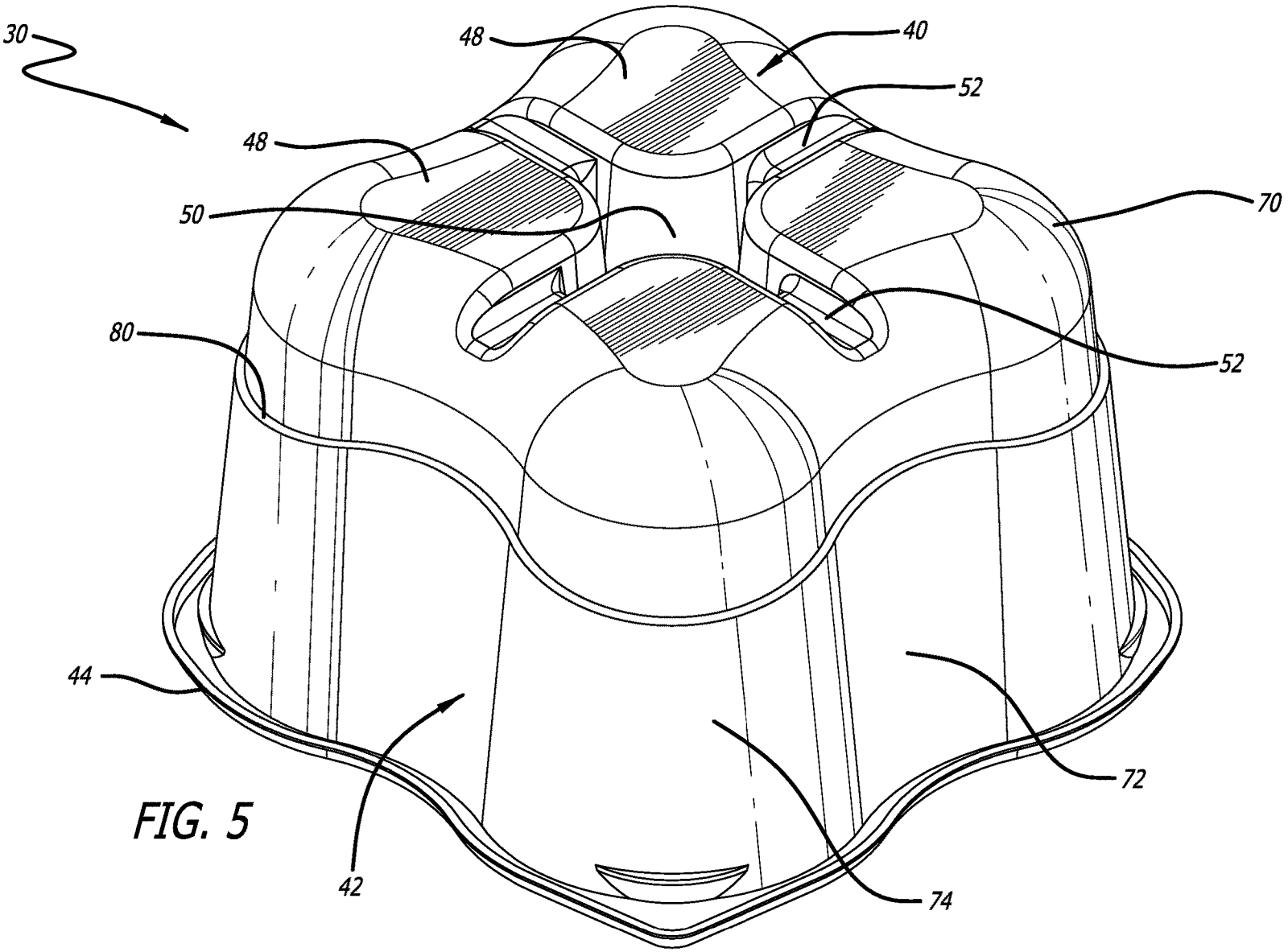
FIG. 5 is a perspective view of an underside of the produce tray.
Figure 6:
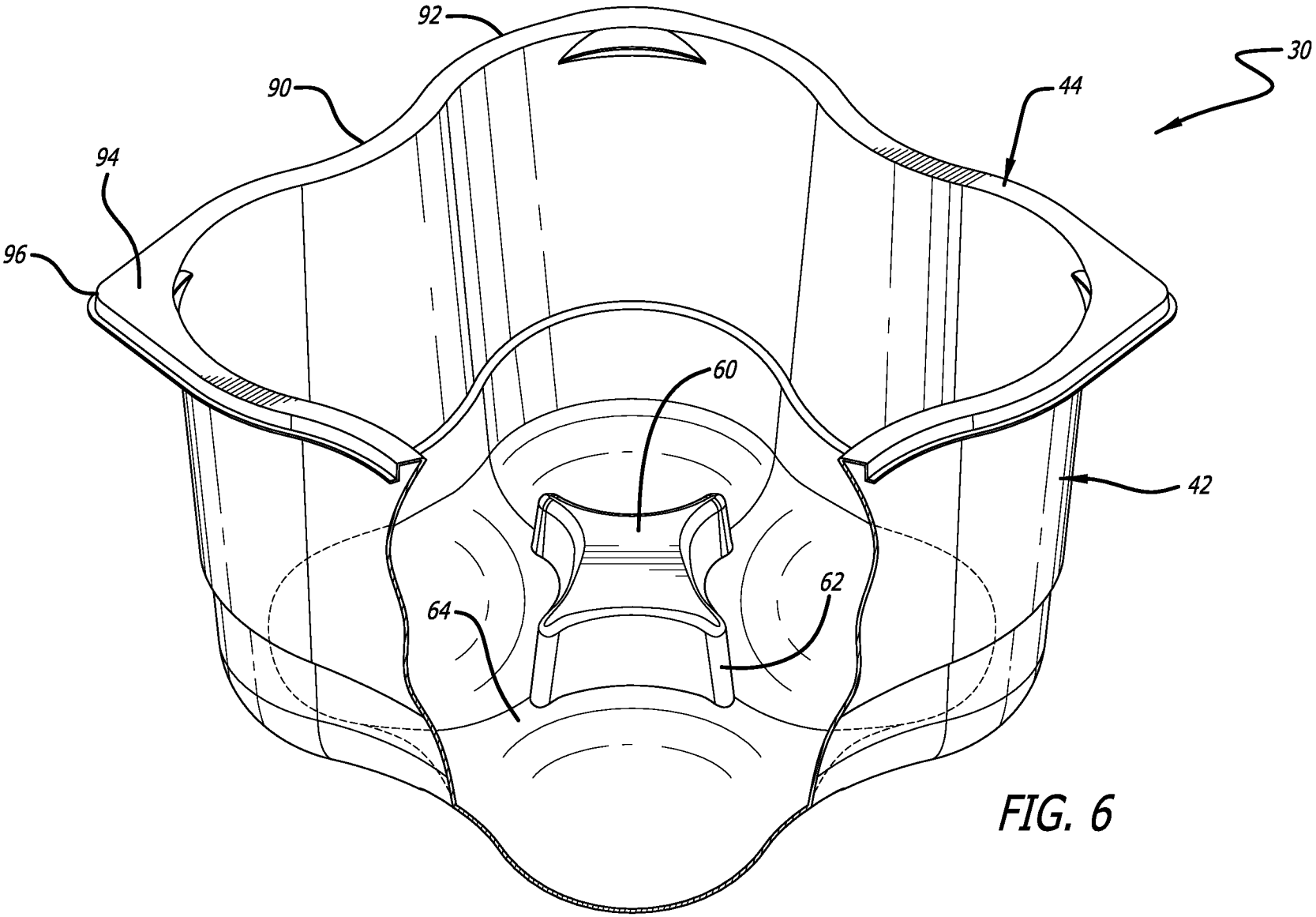
FIG. 6 is a perspective view of an inner cavity of the produce tray illustrating a preferred shape for segregating four avocados or other pieces of produce.

Still with reference to FIGS. 5 and 6, the lower surface 48 transitions to the upstanding walls 42 via a gently curved lower corner edge 70. Because the produce tray 30 is designed to contain four pieces of produce, the upstanding walls 42 generally define a rectangular periphery with four side portions 72 separated by four corners 74. The upstanding walls 42 are gradually tapered wider as they rise up from the floor 40, and have an undulating shape with a convex-out corner 74 between adjacent concave-out side portions 72. The same undulating shape continues downward and is reflected in an undulating shape of the lower corner edge 70 around the periphery of the tray. In this manner, the tray 30 is semi-segregated into four evenly distributed somewhat rounded compartments for cradling separate pieces of produce within the inner cavity 46. It should be understood that a similar geometric arrangement could be formed for a different tray designed to hold two, three, or more than four pieces of produce. For example, a tray for holding six plums would have a generally hexagonal peripheral shape with molded features that segregate the inner cavity into six evenly distributed compartments around a central protrusion. Similarly, the relative heights of the upstanding walls and inner protrusions may vary depending on the size of produce.

A horizontal step 80 is formed around the entirety of the upstanding walls 42 at a location a short distance above the lower corner edge 70. More particularly, the step 80 is formed by a small outward jog in the walls 42 from lower to upper. As best seen in FIG. 8, the step 80 provides a ledge which helps maintain a small pre-determined spacing between the produce trays 30 when nested together. The step 80 also adds structural rigidity to the upstanding walls 42. Although generally horizontal, the step 80 also undulates somewhat up at the corners 74 and down at the side portions 72, as seen best in FIG. 7.

With reference back to FIGS. 1 and 2, the flexible film 32 spans the upper opening of the tray 30 and is secured around the upper lip 44. The upper lip 44 has a horizontal upper rim 82 (FIG. 8) which extends directly outward from the adjacent upstanding walls 42. The flexible film 32 secures directly to the horizontal upper rim 82, preferably by heat welding. The upper lip 44 further defines a generally vertical skirt 84 extending downward from the upper rim 82 and terminating in an outwardly-directed flange 86. This is best seen in the sectional views of FIGS. 7 and 8. This construction of the upper lip 44 provides a convenient handle of sorts for grasping and also strengthens the integrity of the upper periphery of the tray 30.

With reference to FIG. 6, the upper lip 44 generally follows the aforementioned undulating contour of the upstanding walls 42 such that concave segments 90 along the center of each side are connected by convex corners 92. Two of the diametrically-opposed corners 92 also feature an outwardly-projecting ledge 94 having a pointed shape that terminates in a rounded corner 96 of approximately 90°. These ledges 94 provide convenient features for grasping by a user, and also a larger horizontal surface area to locate a small tab 98 on the flexible film 32 that is not secured to the upper lip 44 (See FIG. 2). That is, one or both of the tabs 98 on the flexible film 32 that is shaped to match the outwardly-projecting ledges 94 may remain loose and not adhered to the upper lip 44 so that they may be grasped by a user and pulled upward to remove the film 32 from the tray 30.

As seen in FIG. 2, an aperture 100 is formed in the flexible film 32. In the illustrated embodiment, the aperture 100 is singular, circular, and central, although these are merely matters of preference. The breathable membrane 34 comprises a patch adhered to the underside of the flexible film 32 so as to span across and occlude the aperture 100. In a preferred embodiment, the membrane 34 is formed as a square having a dimension of 2"×2" which covers a 1" diameter hole in the film. The benefits of the assembly of the film 32 and membrane 34 will be described below following a brief discussion of the characteristics of the film 32 at different temperatures.

The film 32 is desirably intended to transmit water vapor throughout the packaging and shipping process so as to avoid build-up of moisture within the inner cavity 46, which naturally retards mold growth. An exemplary film of this sort is an extruded monolayer polymer biaxially-orientated polyester film. Such a film may be obtained from DuPont under the tradename Mylar HXO2AP, which has an amorphous polyester heat seal layer with antifog on one side combined with a crystalline co-polymer that possesses an intrinsically higher rate of water vapor transmission compared to standard PET films of the same thickness. An exemplary thickness is 100 gauge (1 mil, 0.001 inch). The water vapor transmission rate is around 8 g/100 $in^2$/24 hr. The end result is an optimal water vapor transmission rate when in storage and during shipping.

Figure 3:
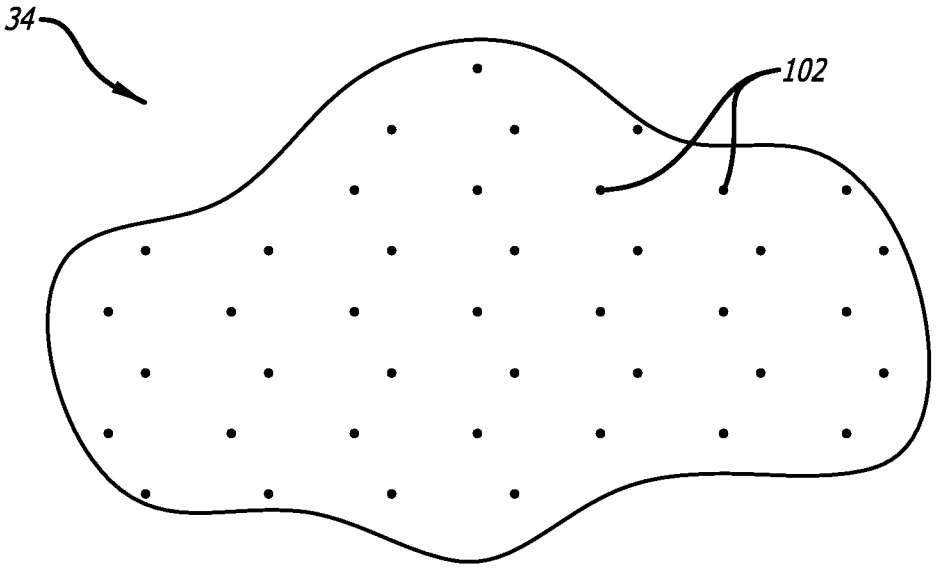
FIG. 3 is a schematic representation of a portion of the breathable membrane at a low temperature wherein pores in the membrane are relatively small.
Figure 4:
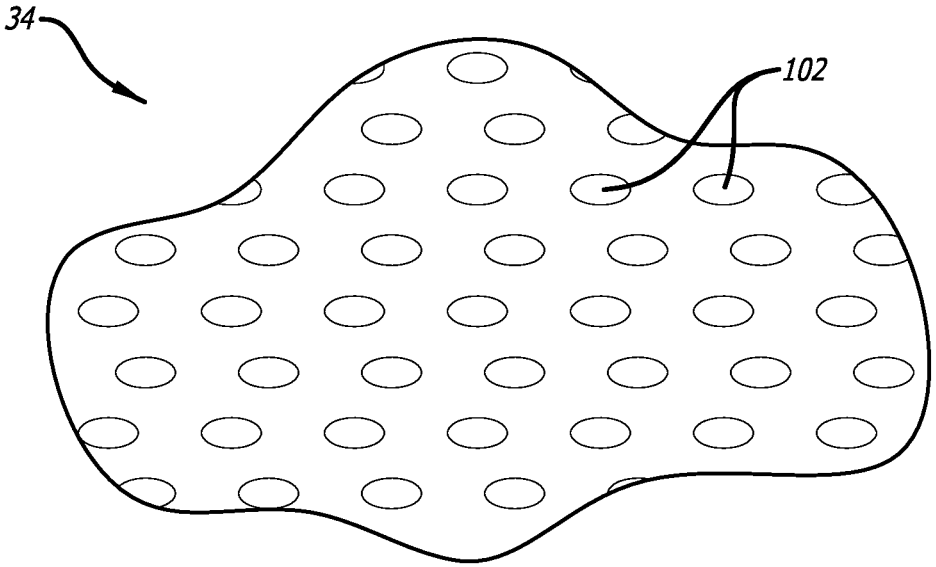
FIG. 4 is a schematic representation of the same portion of the breathable membrane at an elevated temperature wherein the pores are enlarged.

FIG. 3 is a schematic representation of a portion of the breathable membrane 34 at a low temperature wherein microholes or pores 102 in the membrane are relatively small, while FIG. 4 shows the same portion of the membrane at an elevated temperature wherein the pores 102 are enlarged. The breathable membrane 34 comprises a two-layer patch that adheres to the underside of the flexible film 32, around the periphery of the aperture 100. By adhering the label inside the film 32, the customer cannot remove it. Typically, a label indicating the type of breathable membrane material is visible on the membrane 34 through the aperture 100. In one exemplary construction, a structural base layer of a breathable nylon underlies an upper polymer layer which has the pores 102 and to which adhesive is applied. One such membrane material is available under the tradename BreatheWay® from Landec Corp. of Menlo Park, Calif. The composition of a suitable breathable membrane is disclosed in U.S. Pat. No. 7,329,452 to Clarke, whose contents are expressly incorporated herein.

A preferred assembly method includes first printing multiple product labels in series on a long strip of the flexible film 32 which is wound onto a spool. After printing, the film 32 is un-wound and the apertures 100 are die-cut punched. The breathable membrane patches 34 are then placed over the apertures 100, and the film is re-wound onto a roll. The roll of film 32 with the attached membrane 34 is sent to a packing plant where it is mounted on a top sealing machine. Subsequently, 4-pack trays (with 4 ripe avocados inside) are run through the top sealing machine and the film 32 sealed to the PET plastic tray 30. Desirably, these steps are all automated.

Figure 7:
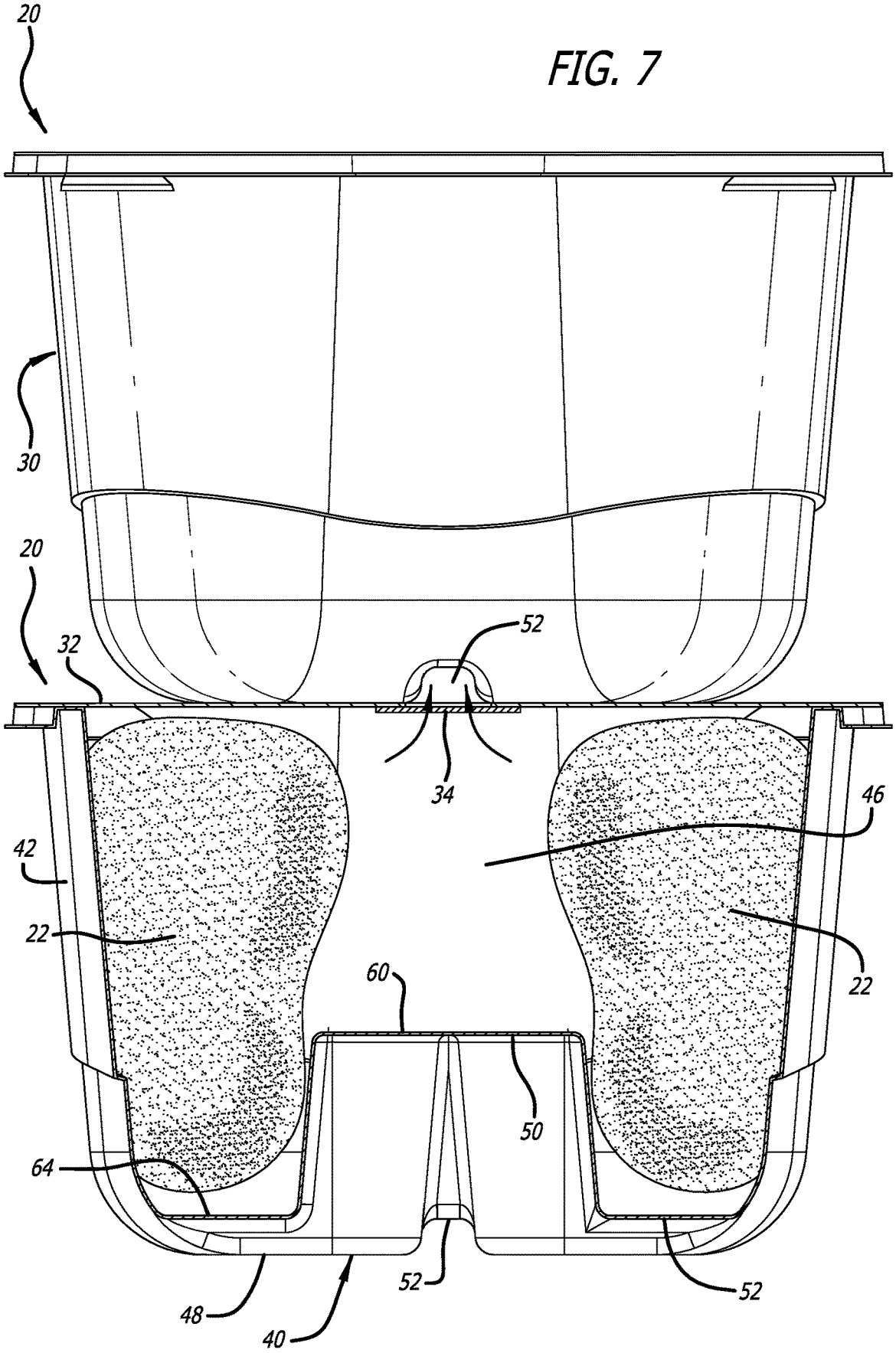
FIG. 7 is a partial sectional view of two stacked produce tray systems containing produce indicating a beneficial airflow therebetween.
Figure 8:
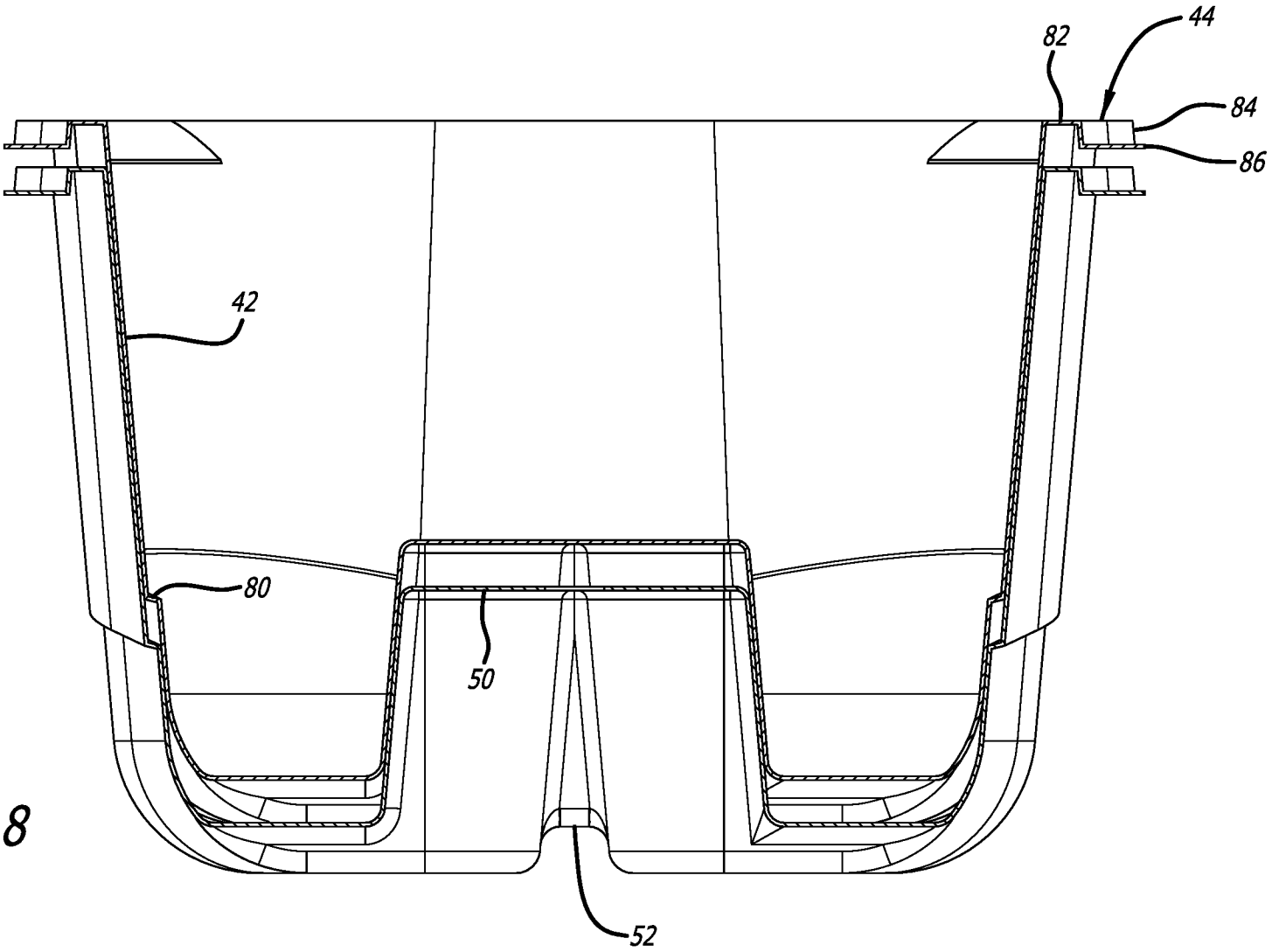
FIG. 8 is a sectional view of two of the produce trays stacked together prior to assembly with the flexible film and breathable membrane.

FIG. 7 is a partial sectional view of two stacked produce tray systems 20 containing produce indicating a beneficial airflow therebetween. That is, when two trays 30 are vertically aligned, the central depression 50 of an upper tray 30 is located immediately above the centered membrane 34 of a lower tray system 20. The four outwardly-extending radial channels 52 are in direct communication with the central depression 50. This permits good airflow through the membrane 34 so that gasses may be transferred in and out of the inner cavity 46 surrounding the avocados 22. The number and size of the microholes or pores 102 in the membrane 34 determines the precise gas transference and at what transition temperature. In an exemplary embodiment, the pores 102 remain substantially closed below a threshold temperature such that the primary transfer of matter in and out of the tray 30 is the escape of water vapor through the flexible film 32. Above the threshold temperature, the pores 102 open and the amount of $O_2$ and $CO_2$ within the inner cavity 46 is allowed to equilibrate. For example, the pores 102 may fully open above 68° F., which is a common ambient temperature in a market. Until the packaged tray 20 reaches the market, the temperature is held below 68° F., which maintains a concentrated $CO_2$ atmosphere within the inner cavity 46 so as to retard ripening of the avocados 22 or other produce. Once $O_2$ and $CO_2$ transfer occurs, ripening speeds up, which is not desirable if the produce is ripe or near ripe when picked. The membrane 34 acts to slow the ripening down even further when the temperature rises.

The intent of the currently disclosed package is not to quickly ripen the avocados in the package, but instead slow down the ripening of the avocados, especially at higher temperatures. The package enables ripe or almost ripe avocados to be packed into a sealed package, and the membrane 34 then controls the $O_2$ and $CO_2$ inside the package depending on temperature. With ripe avocados inside the sealed package having the membrane 34, and stored at 40° F., the $O_2$ level is around 10% and the $CO_2$ level is around 4%. The cooler temperature helps to slow respiration of the avocado thus slowing the ripening (due to cooling). At elevated temperatures the fruit will begin to respire more and ripen faster. However, the membrane 34 adjusts to the higher temperatures, and as result, the atmosphere inside the sealed packed changes to 8% $CO_2$ and 4% $O_2$, even though the pores 102 open up. When this occurs, the avocados receive less $O_2$ and slow down their respiration, and thus their ripening. Normally, when the retailer places the ripe avocados on the store shelf at 68° F. the avocados would tend to ripen faster at the hotter temperatures. The present package 20 slows this ripening down when the ripe avocados are sitting on the store shelf. This will mean less waste, and longer shelf life of the avocados for the consumer.

The preferred packaging atmosphere is a relatively high $CO_2$ content and a relatively low $O_2$ content. In order to obtain such a packaging atmosphere in the modified atmosphere package, it is desirable to make use of a membrane 34 which has a relatively low COTR/OTR ratio (often referred to herein as the R ratio, where COTR is the $CO_2$ transmission rate and OTR is the $O_2$ transmission rate). At higher temperatures, i.e. >68° F., the membrane structure adjusts to decrease the COTR/OTR—which means that the atmosphere inside the container is higher in $CO_2$ than $O_2$. Higher $CO_2$ puts the fruit to "sleep," slows respiration and slows ripening. Decreasing the $O_2$ helps to retard respiration of the fruit and slows the ripening process. The goal with the present package is to pack ripe or almost ripe fruit, and then control and slow further ripening of the fruit, thereby extending the shelf life of ripe fruit. That is, an increase in the $CO_2$ inside the package as the fruit respires acts as a negative feedback and slows the respiration of the fruit.

FIG. 8 is a sectional view of two of the produce trays 30 nested together prior to assembly with the flexible film 32 and breathable membrane 34. As explained above, the gradually tapering shape of the tray 30 along with the horizontal steps 80 permit multiple trays 30 to be stacked/nested prior to being filled with produce and assembled into the final package.

Unless otherwise indicated or the context suggests otherwise, as used herein, "a" or "an" means "at least one" or "one or more."

Furthermore, unless otherwise stated, any specific dimensions mentioned in this description are merely representative of an exemplary implementation of a device embodying aspects of the invention and are not intended to be limiting.

While the present invention has been described and shown in considerable detail with reference to certain illustrative embodiments, including various combinations and sub-combinations of features, those skilled in the art will readily appreciate other embodiments and variations and modifications thereof as encompassed within the scope of the present invention. Moreover, the descriptions of such embodiments, combinations, and sub-combinations is not intended to convey that the invention requires features or combinations of features other than those expressly recited in the claims. Accordingly, the present invention is deemed to include all modifications and variations encompassed within the spirit and scope of the following appended claims.

It is claimed:

1. A produce tray system, including:

a molded produce tray of solid continuous construction without vents having a general bowl-shape with a floor and upstanding side walls rising to an upper lip, the floor and upstanding side walls surrounding an inner cavity for holding separate pieces of produce within the inner cavity;

a flexible film attached across the upper lip to enclose the cavity, the film being configured to permit passage of water vapor; and a breathable membrane mounted on the flexible film so that an underside is exposed to the cavity and a top side is exposed to atmosphere above the flexible film, the membrane having at least a polymer layer with pores whose size varies based on temperature and a COTR/OTR ratio ($CO_2$ transmission rate relative to an $O_2$ transmission rate) which decreases at higher temperatures so as to lower the rate of $CO_2$ transmission relative to $O_2$ transmission at higher temperatures.

2. The system of claim 1, wherein the pores of the breathable membrane are configured to fully open above 68° F.

3. The system of claim 1, wherein the breathable membrane comprises a breathable structural base layer adhered to the polymer layer.

4. The system of claim 1, wherein the breathable membrane is formed in the shape of a patch adhered on an underside of the flexible film over an aperture in the film.

5. The system of claim 4, wherein the floor of the produce tray has a plurality of gas flow channels formed on an underside thereof and extending between side walls, wherein at least one of the gas flow channels of a first tray system stacked directly above a second tray system is positioned directly above the aperture in the film of the second tray system such that gas may flow through the membrane of the second tray system between the cavity of the second tray system and the gas flow channels under the produce tray of the first tray system.

6. The system of claim 5, wherein the floor of the tray defines upstanding features in the inner cavity corresponding to an inverse shape of the gas flow channels formed on the underside thereof, the upstanding features forming separate compartments each sized and shaped to hold a single piece of produce.

7. The system of claim 5, wherein the gas flow channels include a central depression and a spoke-shaped array of radial channels extending outwardly from the central depression, wherein the aperture in each film is centrally located so that the membrane of the second tray system is positioned under the central depression of the first tray system.

8. The system of claim 1, wherein the upper lip includes at least one extended ledge, and wherein a flap of the flexible film remains unattached at the extended ledge to provide a pull tab for removing the flexible film from the tray.

9. The system of claim 1, wherein the upstanding side walls are gradually tapered wider from the floor upward so that a plurality of trays may be nested together, and the tray further includes a horizontal step around a periphery of the upstanding side walls that helps maintain a pre-determined spacing between nested trays.

10. A produce tray system, including:

a molded produce tray of solid continuous construction without vents having a general bowl-shape with a floor and upstanding side walls rising to an upper lip, the floor and upstanding side walls surrounding an inner cavity for holding separate pieces of produce within the inner cavity, and wherein the floor of the produce tray has a plurality of gas flow channels formed on an underside thereof and extending between side walls such that when placed on a flat surface gas may flow under the produce tray along the gas flow channels;

a flexible film attached across the upper lip to enclose the cavity, the film being configured to permit passage of water vapor; and a breathable membrane configured to permit passage of gas mounted on the flexible film so that an underside is exposed to the cavity and a top side is exposed to atmosphere above the flexible film, the membrane having at least a polymer layer with pores whose size varies based on temperature, the membrane being mounted so that when a first tray system is stacked directly above a second tray system at least one of the gas flow channels of the first tray system is positioned directly above the membrane in the second tray system.

11. The system of claim 10, wherein the breathable membrane is configured to lower the rate of $CO_2$ transmission relative to $O_2$ transmission at higher temperatures.

12. The system of claim 11, wherein the film is an extruded monolayer polymer biaxially-orientated polyester film.

13. The system of claim 10, wherein the pores of the breathable membrane are configured to fully open above 68° F.

14. The system of claim 10, wherein the breathable membrane comprises a breathable structural base layer adhered to the polymer layer.

15. The system of claim 10, wherein the breathable membrane is formed in the shape of a patch adhered on an underside of the flexible film over an aperture in the film.

16. The system of claim 15, wherein the gas flow channels include a central depression and a spoke-shaped array of radial channels extending outwardly from the central depression, wherein the aperture in each film is centrally located so that the membrane of the second tray system is positioned under the central depression of the first tray system.

17. The system of claim 10, wherein the floor of the tray defines upstanding features in the inner cavity corresponding to an inverse shape of the gas flow channels formed on the underside thereof, the upstanding features forming separate compartments each sized and shaped to hold a single piece of produce.

18. The system of claim 17, wherein the upstanding features include a central protrusion and a plurality of radial rails defining concave lobes around the central protrusion that form the separate compartments.

19. The system of claim 10, wherein the upper lip includes at least one extended ledge, and wherein a flap of the flexible film remains unattached at the extended ledge to provide a pull tab for removing the flexible film from the tray.

20. The system of claim 10, wherein the upstanding side walls are gradually tapered wider from the floor upward so that a plurality of trays may be nested together, and the tray further includes a horizontal step around a periphery of the upstanding side walls that helps maintain a pre-determined spacing between nested trays.

* * * * *